US007173365B2

(12) United States Patent
Lee et al.

(10) Patent No.: US 7,173,365 B2
(45) Date of Patent: Feb. 6, 2007

(54) FIELD EMISSION DISPLAY HAVING EMITTER ARRANGEMENT STRUCTURE CAPABLE OF ENHANCING ELECTRON EMISSION CHARACTERISTICS

(75) Inventors: Chun-Gyoo Lee, Cwacheon (KR); Sang-Jo Lee, Kyungki-do (KR); Byong-Gon Lee, Suwon (KR); Sang-Hyuck Ahn, Seoul (KR); Tae-Sik Oh, Suwon (KR); Jong-Min Kim, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 90 days.

(21) Appl. No.: 10/370,851

(22) Filed: Feb. 21, 2003

(65) Prior Publication Data

US 2004/0119396 A1 Jun. 24, 2004

(30) Foreign Application Priority Data

Dec. 20, 2002 (KR) ..... 10-2002-0081696

(51) Int. Cl.
*H01J 1/62* (2006.01)

(52) U.S. Cl. ..... 313/495; 313/496; 313/497

(58) Field of Classification Search ..... 313/495–498
See application file for complete search history.

(56) References Cited

U.S. PATENT DOCUMENTS

| | | | | |
|---|---|---|---|---|
| 3,789,471 | A | 2/1974 | Spindt et al. | |
| 5,726,530 | A * | 3/1998 | Peng | 313/495 |
| 6,062,931 | A | 5/2000 | Chuang et al. | |
| 6,097,138 | A | 8/2000 | Nakamoto | |
| 6,239,547 | B1 * | 5/2001 | Uemura et al. | 313/495 |
| 6,246,168 | B1 | 6/2001 | Kishi et al. | |
| 6,420,726 | B2 | 7/2002 | Choi et al. | |

(Continued)

FOREIGN PATENT DOCUMENTS

| | | |
|---|---|---|
| JP | 2000-268704 | 9/2000 |

OTHER PUBLICATIONS

Patent Abstract of Japan, Publication No. 2000-268704, Published on Sep. 29, 2000, in the name of Futaba Corp.

(Continued)

*Primary Examiner*—Nimeshkumar D. Patel
*Assistant Examiner*—Dalei Dong
(74) *Attorney, Agent, or Firm*—Christie, Parker & Hale, LLP

(57) ABSTRACT

A field emission display. Gate electrodes are formed in a predetermined pattern on a first substrate. An insulation layer is formed on the first substrate covering the gate electrodes. Cathode electrodes are formed in a predetermined pattern on the insulation layer. Emitters are provided electrically contacting the cathode electrodes. A second substrate is provided opposing the first substrate with a predetermined gap therebetween. The first substrate and the second substrate form a vacuum container. An anode electrode is formed on a surface of the second substrate opposing the first substrate. Phosphor layers are formed in a predetermined pattern on the anode electrode. Portions of the cathode electrodes are removed to form emitter-receiving sections. Fences are formed between the emitter-receiving sections, one of the emitters being provided in each of the emitter-receiving sections electrically contacting the cathode electrodes.

19 Claims, 9 Drawing Sheets

U.S. PATENT DOCUMENTS

| | | | | |
|---|---|---|---|---|
| 6,545,396 | B1 * | 4/2003 | Ohki et al. | 313/309 |
| 6,577,057 | B1 * | 6/2003 | Yamamoto et al. | 313/495 |
| 6,621,232 | B2 | 9/2003 | Jo et al. | |
| 6,717,340 | B2 * | 4/2004 | Nishimura | 313/310 |
| 6,741,019 | B1 * | 5/2004 | Filas et al. | 313/355 |
| 2001/0006232 | A1 * | 7/2001 | Choi et al. | 257/10 |
| 2004/0012327 | A1 * | 1/2004 | Shiratori et al. | 313/497 |

OTHER PUBLICATIONS

Lee, et al., "32" Under-Gate CNT Cathode for Large TV Applications, Technical Digest vol. 1/2, 15th International Vacuum Microelectronics Conference & 48th International Field Emission Symposium, Jul. 7-11, 2002, Lyon, France.

* cited by examiner

FIELD EMISSION DISPLAY HAVING EMITTER ARRANGEMENT STRUCTURE CAPABLE OF ENHANCING ELECTRON EMISSION CHARACTERISTICS

CROSS REFERENCE TO RELATED APPLICATIONS

This application claims priority to and the benefit of Korea Patent Application No. 2002-0081696 filed on Dec. 20, 2002 in the Korean Intellectual Property Office, the entire disclosure of which are incorporated herein by reference.

BACKGROUND OF THE INVENTION (a) Field of the Invention

The present invention relates to a field emission display, and more particularly, to a field emission display having emitters made of carbon nanotubes.

(b) Description of the Related Art

The field emission display (FED) uses a cold cathode as the source for emitting electrons to realize images. The overall quality of the FED depends on the characteristics of emitters, which form an electron emitting layer. The first FEDs utilized emitters made mainly of molybdenum (Mo), that is, the emitters were formed of what are referred to as Spindt-type metal tips. As an example of such prior art technology, there is disclosed a display system that has a field emission cathode in U.S. Pat. No. 3,789,471.

However, during manufacture of the FED having metal tip emitters, since a semiconductor manufacturing process is used, which includes photolithography and etching processes to form holes in which emitters are provided and the process of depositing molybdenum to form metal tips, not only is production complicated and a high technology is needed, but expensive equipment is required, thereby increasing overall unit costs. These factors make mass production of such FEDs problematic.

Accordingly, much research and development is being performed by those in the field emission display industry to form emitters in a flat configuration that enable electron emission at low voltages (10~50V) and a simple manufacture of the emitter structure. It is known that carbon-based materials, for example, graphite, diamond, DLC (diamond-like carbon), $C_{60}$ (Fullerene), or carbon nanotubes, are suitable for use in the manufacture of planar emitters. In particular, it is believed that carbon nanotubes, with their ability to realize electron emission at relatively low driving voltages of approximately 10~50V, is the ideal emitter configuration for FEDs.

U.S. Pat. Nos. 6,062,931 and 6,097,138 disclose cold cathode field emission displays that are related to this area of FEDs using carbon nanotube technology. The FEDs disclosed in these patents employ a triode structure having cathodes, an anode, and gate electrodes. During manufacture of these FEDs, cathode electrodes are first formed on a substrate, then after providing emitters on the cathode electrodes, the gate electrodes are formed on the emitters. That is, the prior art FEDs have a structure in which the gate electrodes are provided between the cathode electrodes and an anode electrode, and electrons emitted from the emitters are induced toward a phosphor layer.

To improve the characteristics of the FED, the above triode structure is used and the emitters are formed using a carbon-based material, that is, carbon nanotubes. However, it is difficult to precisely form the emitters in holes formed in an insulation layer, which is provided under the gate electrodes. This is a result of the difficulties involved in forming the emitters with a printing process that uses paste. In particular, it is very difficult to provide the paste in the minute holes for formation of the emitters.

Further, with respect to the FED having the conventional triode structure, when the electrons emitted from the emitters form electron beams and travel in this state toward their intended phosphors, there are instances when an excessive diverging force of the electron beams is given by gate electrodes when passing a region of the gate electrodes to which a positive voltage is applied. In such a case, the electron beam emitted from an emitter illuminates a phosphor adjacent to the intended phosphor as a result of the undesirable spreading of the electron beams. Therefore, color purity and overall picture quality deteriorate.

To remedy this problem, there has been disclosed a configuration in which a metal grid of mesh type is provided between the cathode electrodes and anode electrode in an effort to realize good focusing control of the electrons emitted from the emitters. Japanese Laid-Open Patent No. 2000-268704 discloses such an FED.

In an FED having the metal grid, in addition to the advantages described, arcing results from the high voltage applied to the anode electrode such that damage to the cathode structure, which includes the emitters, is prevented. However, when electron beams are emitted from the emitters, the electron beams are unable to pass through holes formed in the metal grid and instead strike the metal grid to thereby decrease the utilization efficiency of the electron beams. Hence, because the final number of electron beams reaching the phosphors is lower than needed, brightness of the picture is reduced.

Such a problem may become worse in FEDs in which the gate electrodes are provided under the cathode electrodes on a substrate and the emitters are formed on the cathode electrodes (e.g., U.S. Pat. No. 6,420,726 disclosed by the assignee). This is because most of the emission of the electron beams occurs in the edges of the emitters. If the electron beams do not pass through the metal grid unimpaired, the number of electron beams for illuminating the phosphors is significantly reduced.

In all display devices including the FED, the light emitting source (cold cathode electron emission in the case of FEDs) must uniformly illuminate the pixels to provide for good picture quality. However, the above structure of the emitters in which the emitters are arranged in edge portions of the cathode electrodes is unfavorable for uniformly emitting electrons to each pixel.

This is a result of the small contact area between the emitters and the cathode electrodes that causes an increase in the contact resistance that interferes with electron emission. Further, when the emitters are formed on the cathode electrodes, the arrangement of the emitters is not uniform so that electron emission occurs in sections.

SUMMARY OF THE INVENTION

It is one aspect of the present invention to provide a field emission display that increases electron emission levels and ensures the uniform emission of electrons between pixels. Additional aspects and advantages of the invention will be set forth in part in the description which follows.

According to the above aspect, an embodiment of the present invention provides a field emission display. A plurality of gate electrodes is formed in a predetermined pattern on a first substrate. An insulation layer is formed on the first substrate covering the gate electrodes. A plurality of cathode electrodes is formed in a predetermined pattern on the insulation layer. Emitters are provided electrically contacting the cathode electrodes. A second substrate is provided opposing the first substrate with a predetermined gap therebetween. The first substrate and the second substrate form a vacuum container. An anode electrode is formed on a surface of the second substrate opposing the first substrate. Phosphor layers are formed in a predetermined pattern on the anode electrode. Portions of the cathode electrodes are removed to form emitter-receiving sections. Fences are formed between the emitter-receiving sections, one of the emitters being provided in each of the emitter-receiving sections electrically contacting the cathode electrodes.

The emitter-receiving sections are formed at predetermined intervals along lengths of the cathode electrodes. It is preferable that the emitter-receiving sections are formed along one edge of the cathode electrodes. Also, it is preferable that the emitter-receiving sections are grooves formed along one edge of the cathode electrodes, and that the grooves forming the emitter-receiving sections are rectangular.

The emitters are provided in the emitter-receiving sections forming a closed space with the cathode electrodes. Ends of the emitters may contact side walls of the cathode electrodes within the emitter-receiving sections. Also, the emitters are substantially rectangular having long sides and short sides, and the emitters may be varied in width along a short side direction. In another aspect, the ends of the emitters are inserted into grooves formed in side walls of the cathode electrodes within the emitter-receiving sections.

The emitters may be mounted within the emitter-receiving sections and extending a predetermined distance onto the cathode electrodes. Edges of the emitters closest to the fences may be mounted fully within the emitter-receiving sections and not reaching corresponding edges of the cathode electrodes, or they may be concavely formed.

In addition, a plurality of contact electrodes are formed at predetermined intervals in each of the emitter-receiving sections, the contact electrodes extending from the cathode electrodes, and the emitters are provided in the emitter-receiving sections contacting the contact electrodes. The contact electrodes may be made of the same material as the cathode electrodes, or may be made of a conductive material that is different from the material used for the cathode electrodes. Also, at this time, edges of the emitters closest to the fences may be concavely shaped, may be provided fully within the emitter-receiving sections and not reaching a corresponding edge of the cathode electrodes, may extend out of the emitter-receiving sections and past corresponding edges of the cathode electrodes, or may be aligned with an opening of the emitter-receiving sections, that is, with corresponding edges of the cathode electrodes.

The field emission display also includes a plurality of counter electrodes that are electrically connected to the gate electrodes, are provided on the insulation layer at a predetermined distance from the emitters, and act to form electric fields toward the emitters. The counter electrodes are connected to the gate electrodes through connecting holes formed in the insulation layer.

The emitters are made of a carbon-based material, that is, carbon nanotubes, $C_{60}$ (Fullerene), diamond, DLC (diamond-like carbon), graphite, or a combination of these materials.

Also, a mesh grid is mounted between the cathode electrodes and the anode electrode, and a metal thin film layer formed on the phosphor layers.

DETAILED DESCRIPTION

Various embodiments of the present invention will now be described in detail with reference to the accompanying drawings.

Figure 1:
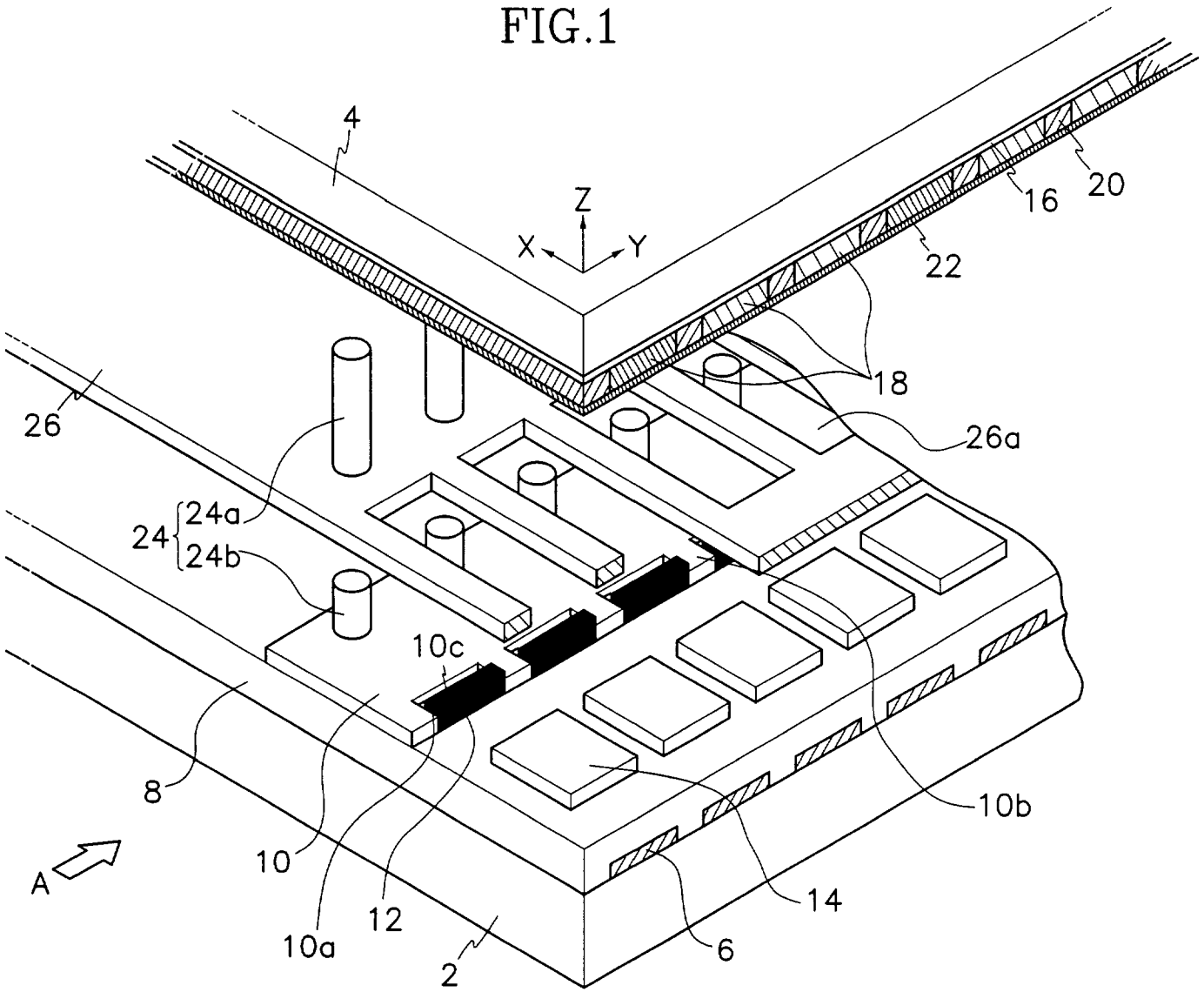
FIG. 1 is a partial perspective view of a field emission display according to a first embodiment of the present invention.
Figure 2:
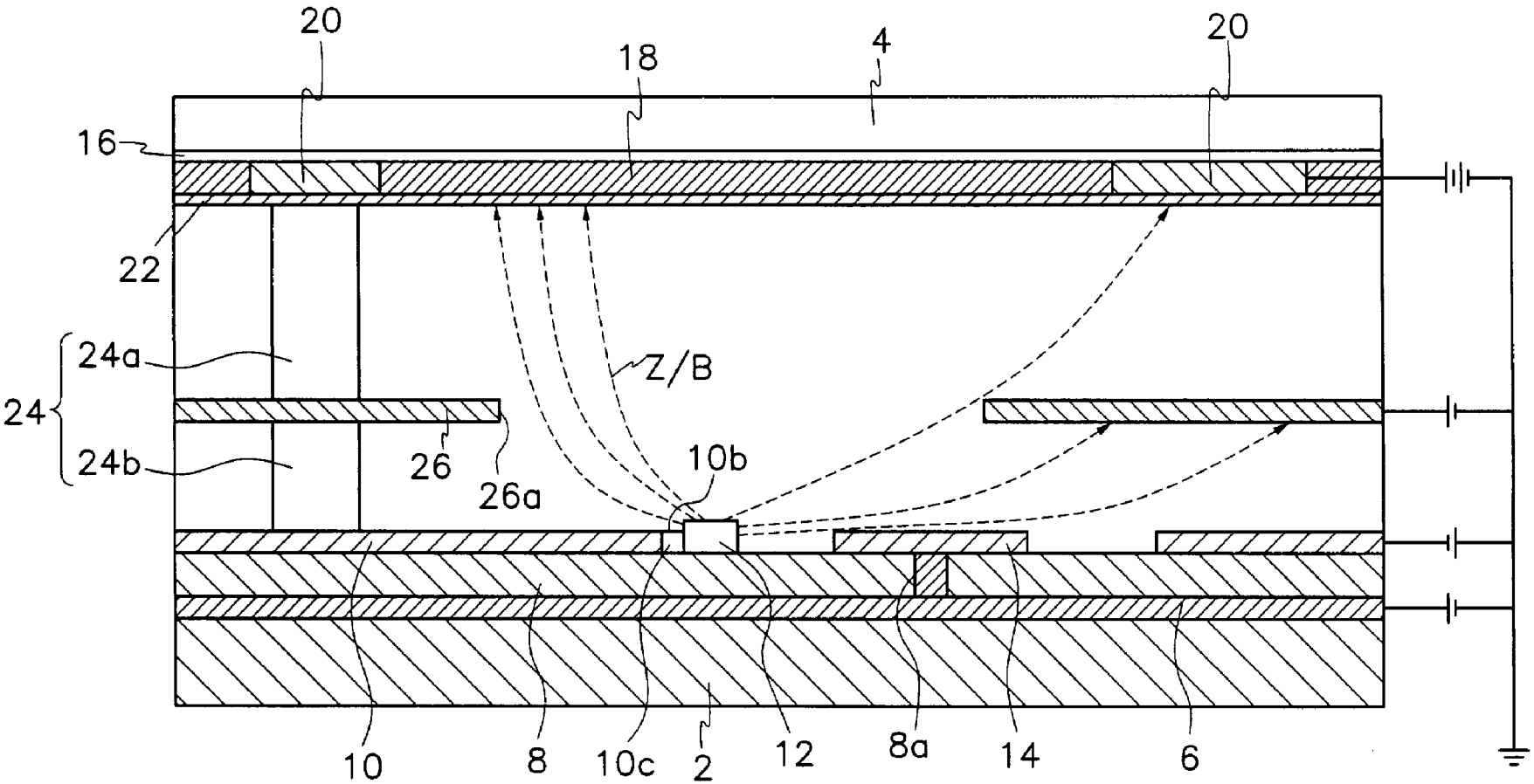
FIG. 2 is a sectional view of the field emission display of FIG. 1.

FIG. 1 is a partial perspective view of a field emission display according to a first embodiment of the present invention, and FIG. 2 is a sectional view of the field emission display viewed from direction A of FIG. 1.

As shown in the drawings, the field emission display (FED) includes first substrate 2 of predetermined dimensions (hereinafter referred to as a rear substrate) and second substrate 4 of predetermined dimensions (hereinafter referred to as a front substrate). Front substrate 4 is provided substantially in parallel to rear substrate 2 with a predetermined gap therebetween, and front substrate 4 and rear substrate 2 are connected in this state to define an exterior of the FED.

A structure to enable the generation of an electric field is provided on rear substrate 2, and a structure to enable the realization of predetermined images by electrons emitted as a result of the generated electric field is provided on front substrate 4. This will be described in more detail below.

A plurality of transparent gate electrodes 6 is formed on rear substrate 2 in a predetermined pattern (e.g., a striped pattern) at predetermined intervals and along an X axis direction of FIG. 1. Further, insulation layer 8 is formed over an entire surface of rear substrate 2 covering gate electrodes 6. Insulation layer 8 may be made of a glass material, $SiO_2$, polyamide, nitride, a compound of these elements, or a structure in which these elements are layered. In the first embodiment of the present invention, the materials used for the insulation layer 8 are transparent.

A plurality of opaque cathode electrodes 10 is formed on insulation layer 8 in a predetermined pattern (e.g., a striped pattern) at predetermined intervals and along a Y axis direction of FIG. 1. Accordingly, cathode electrodes 10 are perpendicular to gate electrodes 6.

Further, emitters 12, which emit electrons by the generation of an electric field in pixel regions of rear substrate 2, are formed within cathode electrodes 10 in the area of the pixel regions. Emitters 12 are formed in a lengthwise direction of cathode electrodes 10. That is, emitters 12 are formed along one of two long edges of each of the cathode electrodes 10 with a predetermined gap therebetween and in such a manner that emitters 12 are positioned corresponding to the locations of pixels.

In conventional FEDs, the emitters are electrically connected to the cathode electrodes. In the first embodiment of the present invention, emitters 12 are provided in emitter-receiving sections 10*a* formed in cathode electrodes 10 to contact the same (i.e., to be electrically connected to cathode electrodes 10). Emitter-receiving sections 10*a* are formed by cutting away portions of cathode electrodes 10. In the first embodiment of the present invention, emitter-receiving sections 10*a* are formed as rectangular grooves. With this formation of emitter-receiving sections 10*a* along one of the long edges of each of cathode electrodes 10 at predetermined intervals (i.e., at positions corresponding to the locations of the pixels), fences 10*b* are formed by cathode electrodes 10 between emitter-receiving sections 10*a*.

The connecting structure between cathode electrodes 10 and emitters 12, which are provided in emitter-receiving sections 10*a* of cathode electrodes 10, will now be described in more detail. Emitters 12 are rectangular corresponding to the shape of emitter-receiving sections 10*a*. When mounted in emitter-receiving sections 10*a*, upper surfaces of emitters 12 oppose front substrate 4. Short sides of emitters 12 are in close contact to cathode electrodes 10, that is, side walls of cathode electrodes 10 defining emitter-receiving sections 10*a*. Further, so that there is provided gap 10*c* between each of emitters 12 and cathode electrodes 10, emitters 12 are not fully inserted within emitter-receiving sections 10*a*. That is, emitters 12 are provided within emitter-receiving sections 10*a* so that long sides of emitters 12 adjacent to cathode electrodes 10 do not contact the same and there is a gap therebetween.

The above is one example of how emitters 12 may be arranged. It is to be assumed that various other configurations are possible.

The emitters 12 are made of a carbon-based material, for example, carbon nanotubes, $C_{60}$ (Fullerene), diamond, DLC (diamond-like carbon), graphite, or a combination of these materials. For manufacture of emitters 12, a screen printing process, a chemical vapor deposition (CVD) method, or a sputtering method may be used. In the first embodiment of the present invention, emitters 12 are made of carbon nanotubes.

Also formed on insulation layer 8 are counter electrodes 14. Counter electrodes 14 enable a desirable emission of electrons from emitters 12 while requiring only a minimal drive voltage to gate electrodes 6. During operation of the FED, a predetermined drive voltage is applied to gate electrodes 6 to generate an electric field between emitters 12 for the emission of electrons. Counter electrodes 14 act to form an additional electric field between themselves and emitters 12. Counter electrodes 14 are arranged corresponding to the area of the pixel regions on rear substrate 2.

In the first embodiment of the present invention, counter electrodes 14 are shaped substantially as regular squares. However, this is not limiting and other shapes may be used.

The counter electrodes 14 are electrically connected to gate electrodes 6 to be linked with the operation of gate electrodes 6. The electrical connection is realized through holes 8*a* formed in insulation layer 8 that expose gate electrodes 6 before mounting of counter electrodes 14. Counter electrodes 14 may extend into holes 8*a* until they contact gate electrodes 6, or other conductive material may be filled into holes 8*a* to interconnect counter electrodes 14 and gate electrodes 6. In addition, holes 8*a* are formed corresponding to the mounting positions of counter electrodes 14 by using a printing process, photolithography process, etc.

Formed on front substrate 4 are anode electrode 16 made of ITO (indium tin oxide), and R,G,B phosphor layers 18 formed at predetermined intervals along the X axis direction. Also, a black matrix 20 for improving contrast is formed on front substrate 4 between phosphor layers 18, and a thin metal film layer 22 made of aluminum or another such material is formed on phosphor layers 16 and black matrix 20. Thin metal film layer 22 aids in improving the voltage withstanding characteristics and brightness characteristics of the FED.

Rear substrate 2 and front substrate 4 are provided substantially in parallel with a predetermined gap therebetween as described above, and in a state where cathode electrodes 10 are perpendicular to phosphor layers 18. Rear and front substrates 2 and 4 are sealed using a sealant such as frit which is applied around a circumference of rear and front substrates 2 and 4. The space between rear and front substrates 2 and 4 is evacuated to realize a vacuum state therebetween. Also, spacers 24 are provided between rear and front substrates 2 and 4 at areas outside the pixel regions. Spacers 24 maintain the predetermined gap between rear and front substrates 2 and 4 uniformly over the entire area of these two elements. In the first embodiment of the present invention, spacers 24 include upper spacers 24*a* for supporting front substrate 4 and lower spacers 24*b* for supporting rear substrate 2.

In addition, mesh grid 26 having a plurality of holes 26*a* is mounted between upper spacers 24*a* and lower spacers 24*b*. Mesh grid 26 prevents damage to cathode electrodes 10 in the case where arcing occurs within the display, and acts to focus the electron beams formed by the emission of electrons by emitters 12. In the first embodiment of the present invention, holes 26*a* of mesh grid 26 correspond to the pixels of rear substrate 2. However, holes 26*a* may also be arranged in a non-uniform manner without corresponding to the locations of the pixels.

In the FED structured as in the above, with the application of predetermined voltages to anode electrode 16, cathode electrodes 10, gate electrodes 6, and mesh grid 26 (from a few to a few tens of a positive voltage to gate electrodes 6, from a few to a few tens of a negative voltage to cathode electrodes 10, from a few hundred to a few thousand of a positive voltage to anode electrode 16, and from a few tens to a few hundreds of a positive voltage to mesh grid 26), an electric field is generated between gate electrodes 6 and emitters 12 such that electrons are emitted from emitters 12. The emitted electrons are formed into electron beams and induced toward phosphor layers 18 to strike the same. Phosphor layers 18 are illuminated as a result to realize predetermined images.

During this operation of the FED, counter electrodes 14 form an additional electrical field between gate electrodes 6 and emitters 12 so that electrons may be emitted from a side of emitters 12 (a right side in the drawings). Further, gaps

10*c* between emitters 12 and cathode electrodes 10 allow the emission of electrons from an opposite side of emitters 12 (a left side in the drawings).

Figure 3A:
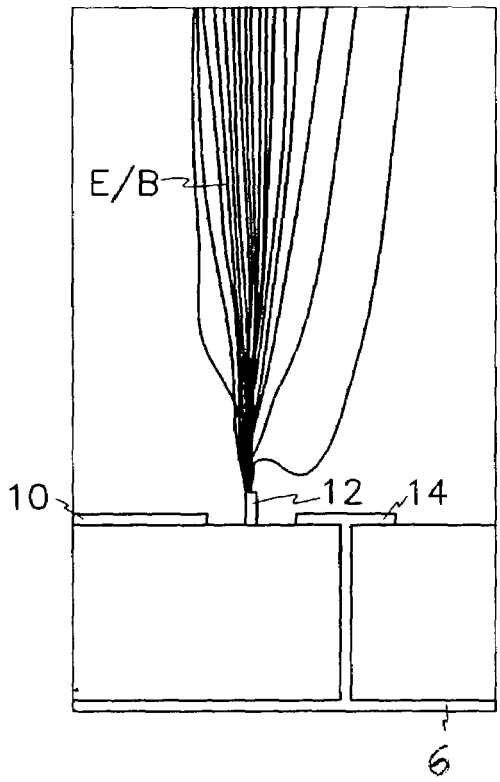
FIGS. 3*a* and 3*b* are drawings showing computer simulations of a trace of electron beams emitted from emitters of the field emission display of FIG. 1.
Figure 3B:
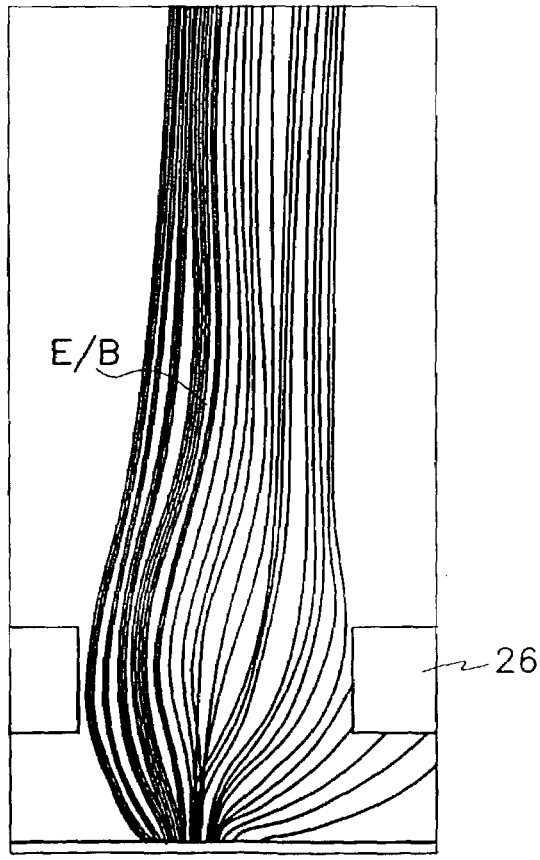

FIGS. 3*a* and 3*b* are drawings showing computer simulations of a trace of electron beams (E/B) emitted from emitters 12 of the FED according to the first embodiment of the present invention. FIG. 3*a* shows in detail the trace of electron beams (E/B) as they leave one of the emitters 12 and travel toward mesh grid 26, while FIG. 3*b* shows in detail the trace of electron beams (E/B) as they pass through mesh grid 26 and travel into the gap between front substrate 4 and rear substrate 2.

Figure 4A:
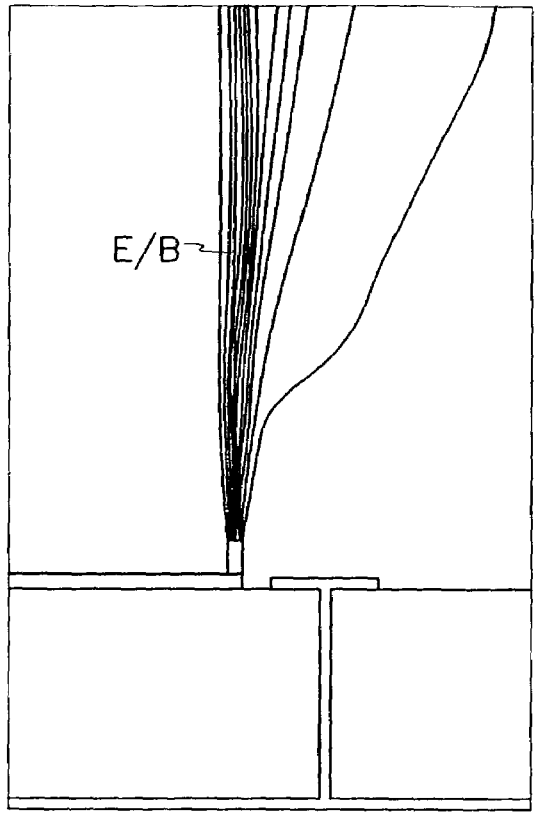
FIG.4A (PRIOR ART)
FIGS. 4*a* and 4*b* are drawings showing computer simulation of a trace of electron beams emitted from emitters of conventional field emission displays.
Figure 4B:
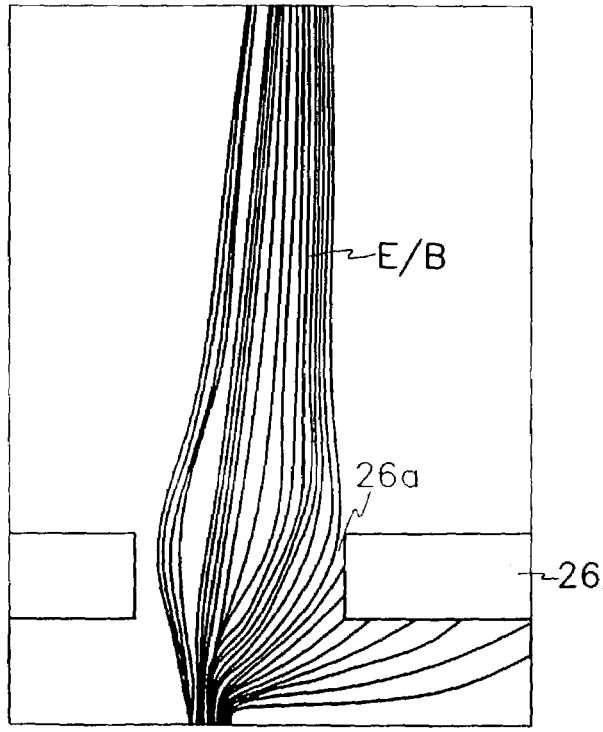
FIG.4B (PRIOR ART)

With reference to FIGS. 3*a* and 3*b*, the electron beams (E/B) emitted from emitters 12 do not lean to one side as in the conventional FED as shown in FIGS. 4*a* and 4*b*, and instead are relatively equally distributed about a corresponding location of the intended phosphor layer. The conventional FED used for comparison is structured with the emitters formed directly on the cathode electrodes, unlike the first embodiment of the present invention.

The favorable formation of the electron beam traces in the FED of the first embodiment of the present invention is a result of electrons being emitted from both long sides of emitters 12. This occurs as a result of gaps 10*c* formed between emitters 12 and cathode electrodes 10 that allow for the generation of electric fields for electron emission also between emitters 12 and cathode electrodes 10 (in addition to the opposite long sides of emitters 12).

Therefore, the electrons are more uniformly emitted from emitters 12 and in greater amounts than in conventional FEDs, resulting in the increased strength of the electron beams landing on phosphor layers 18 to enhance the brightness of the displayed images. Further, the emission of electrons from both sides of emitters 12 results in an increased utilization efficiency of electrons 12 such that the lifespan and reliability of emitters 12 are improved.

The fences 10*b* formed between the emitter-receiving sections 10*a* act as shields to prevent the electric fields generated for each pixel from entering into other pixel regions. As a result, the electron beams formed by the electrons are not influenced by the electric fields of adjacent pixels to better land on their intended phosphors.

On the other hand, in the FED of the comparative example, the generated electron beams lean to one side as shown in FIG. 4*b* (to the right in the drawing) such that many of the electron beams do not pass through hole 26*a* of mesh grid 26 and are blocked by the same. This greatly reduces the number of electron beams that are being used for image generation.

Figure 5:
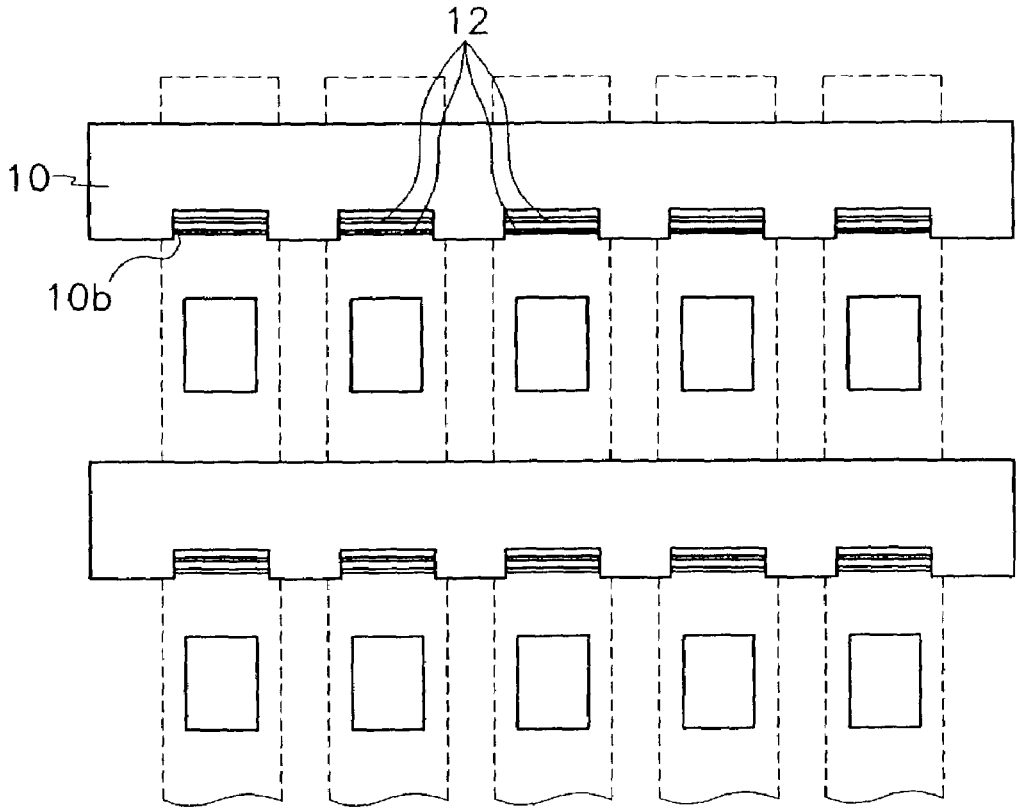
FIGS. 5, 6, and 7 are partial plan views showing modified examples of the field emission display according to the first embodiment of the present invention.

A modified example of the FED according to the first embodiment of the present invention will now be described. FIG. 5 shows a first modified example. In this FED, the basic structure of the FED of the first embodiment of the present invention is used, but there are at least two emitters 12 provided in each of the emitter-receiving sections 10*a* of cathode electrodes 10. With this configuration, electrons are emitted from each of the long edges of each of emitters 12 to thereby further increase the utilization efficiency of the electron beams.

Figure 6:
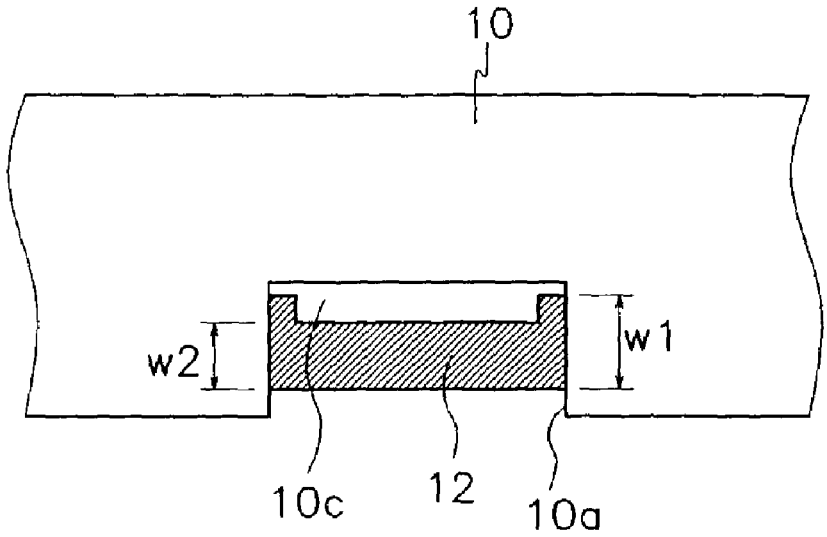

In the second modified example of the FED according to the first embodiment of the present invention, emitters 12 are mounted in emitter-receiving sections 10*a* in such a manner as to minimize contact resistance with cathode electrodes 10. With reference to FIG. 6, the shape of the short sides of emitters 12 is altered from the configuration used in the first embodiment of the present invention. In particular, width w2 of the majority of emitters 12 remains the same, but the short sides of emitters 12 that contact cathode electrodes 10 are increased in size to new width w1 that is greater than width w2. With this configuration, the contact area between emitters 12 and cathode electrodes 10 is increased to reduce the contact resistance between these elements and thereby minimize the negative influence of contact resistance on electron emission.

Figure 7:
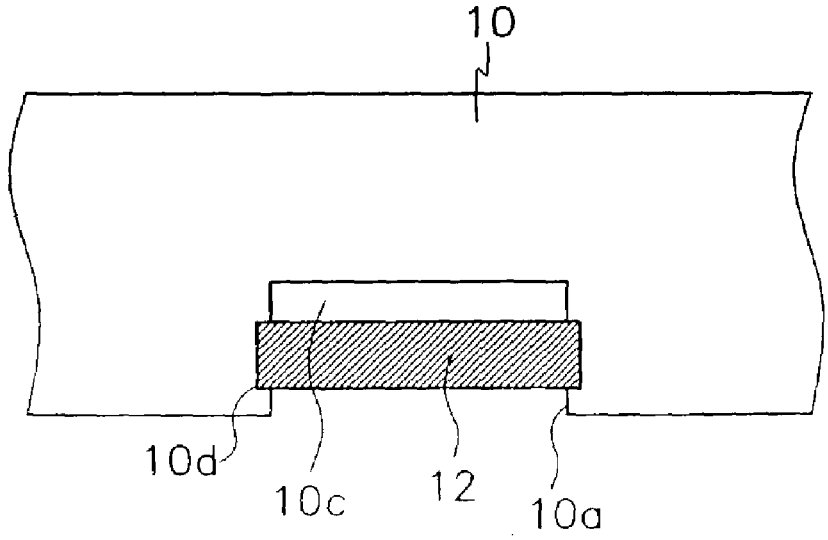

In yet another modified example of the FED according to the first embodiment of the present invention, with reference to FIG. 7, emitters 12 are provided in emitter-receiving sections 10*a* as in the first embodiment of the present invention, and, in addition, ends of emitters 12 are inserted into grooves 10*d* formed in cathode electrodes 10.

Figure 8:
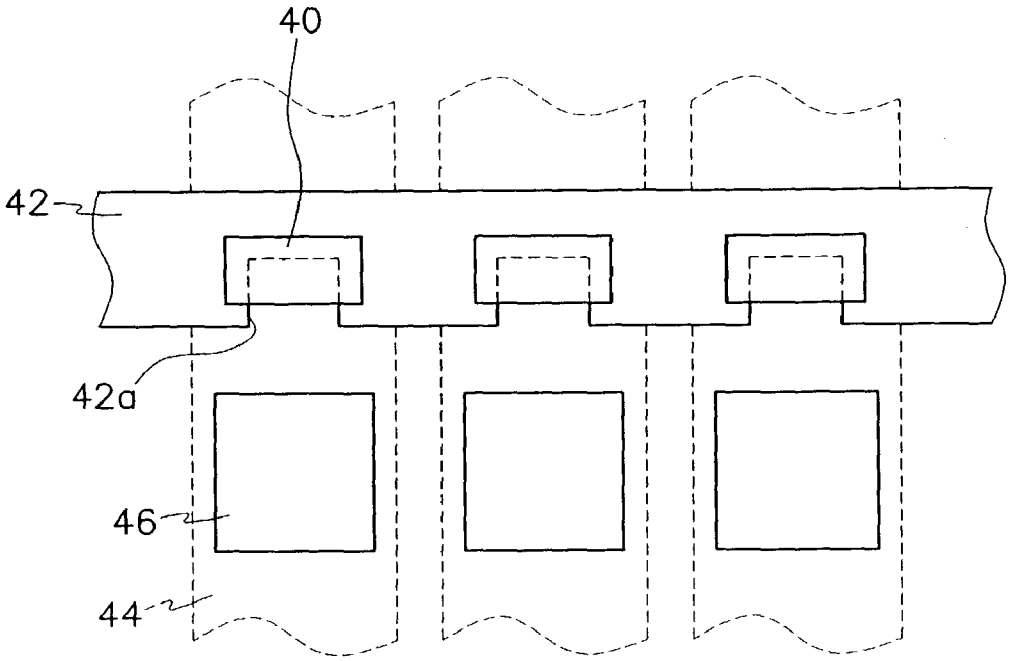
FIG. 8 is a partial plan view showing main parts of a field emission display according to a second embodiment of the present invention.

A second embodiment of the present invention will now be described. FIG. 8 is a partial plan view showing main parts of an FED according to a second embodiment of the present invention.

As shown in the drawing, emitters 40 are provided in emitter-receiving sections 42*a* that are formed in cathode electrodes 42. That is, emitters 40 are provided within emitter-receiving sections 42*a* and extend a predetermined distance over cathode electrodes 42. With this structure, emitters 40 themselves act as resistance layers such that uniform electron emission occurs from all areas of the edges of emitters 40.

In more detail, in the case where the emitters are formed directly over edges of the cathode electrodes (without the formation of emitter-receiving sections) as in conventional devices, the emission of electrons from the emitters varies depending on the area of the emitters. Such variations in the emission of the electrons may be particularly severe in the edges of the emitters. Emitters 40 according to the second embodiment of the present invention act as resistance layers having resistivity such that voltage differences between gate electrodes 44 and cathode electrodes 42 at all areas of the edges of emitters 40 are the same. Therefore, the emission of electrons occurs evenly over all the edge portions of emitters 40.

At this time, it is possible for edges of emitters 40 closest to counter electrodes 46 to be aligned with corresponding edges of cathode electrodes 42. However, it is preferable for emitters 40 to be mounted more inwardly within emitter-receiving sections 42*a* as shown in FIG. 8 such that the edges of emitters 40 and cathode electrodes 42 are unaligned. This allows for better focusing of the generated electron beams.

Figure 9:
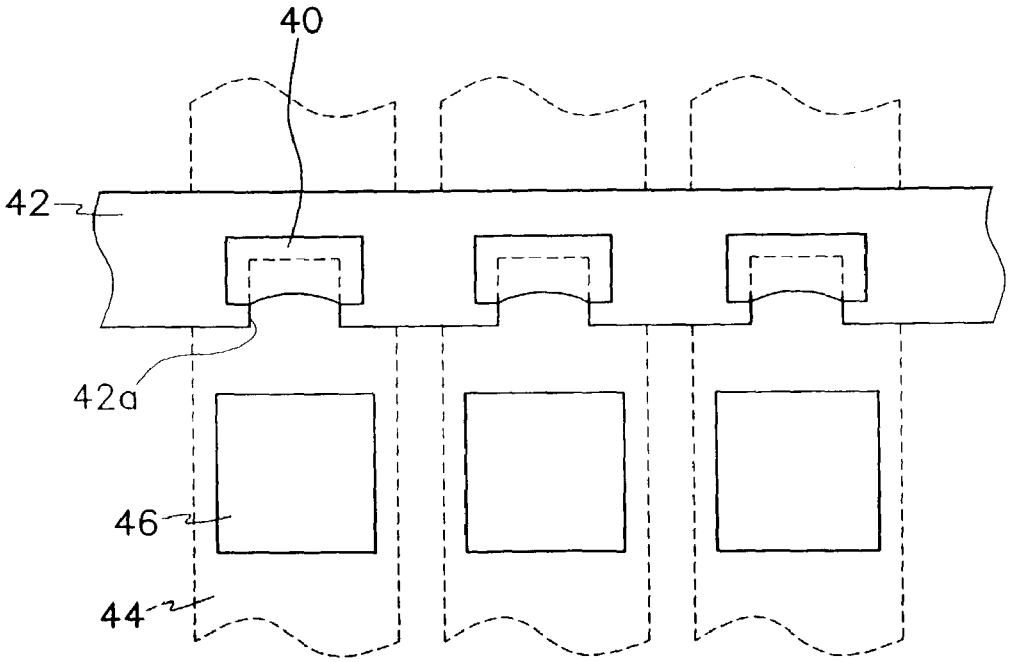
FIG. 9 is a partial plan view used to describe a modified example of the field emission display according to the second embodiment of the present invention.

With reference to FIG. 9, so that the electron beams are concentrated toward a center of emitters 40 to realize better focusing of the electron beams, emitters 40 may be formed with the edge closest to counter electrodes 46 being formed in a concave shape.

Figure 10:
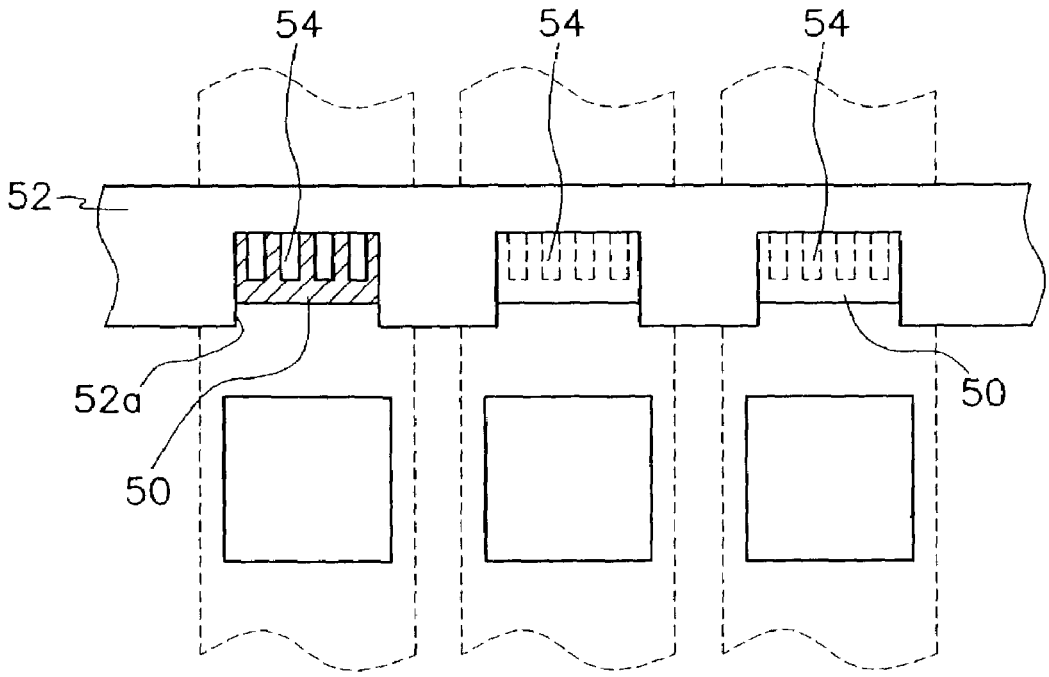
FIG. 10 is a partial plan view showing main parts of a field emission display according to a third embodiment of the present invention.

FIG. 10 is a partial plan view showing main parts of an FED according to a third embodiment of the present invention. The FED according to this embodiment has the same basic structure of the FEDs of the previously-described embodiments. However, the third embodiment differs from the first and second embodiments with respect to a structure used for arranging emitters 50 within emitter-receiving sections 52*a* such that a contact resistance between emitters 50 and cathode electrodes 52 is reduced.

In more detail, emitters 50 are arranged in emitter-receiving sections 52*a* of cathode electrodes 52 contacting a plurality of contact electrodes 54, which are formed extending from cathode electrodes 52 into each of emitter-receiving sections 52*a*. Contact electrodes 54 are quadrilateral and are made of the same material as cathode electrodes 52 such that contact electrodes 54 may be formed at the same time as cathode electrodes 52. Contact electrodes 54 may also be made of a conductive material that is different from that used for cathode electrodes 52, and may be made into other shapes besides a quadrilateral shape.

Figure 11:
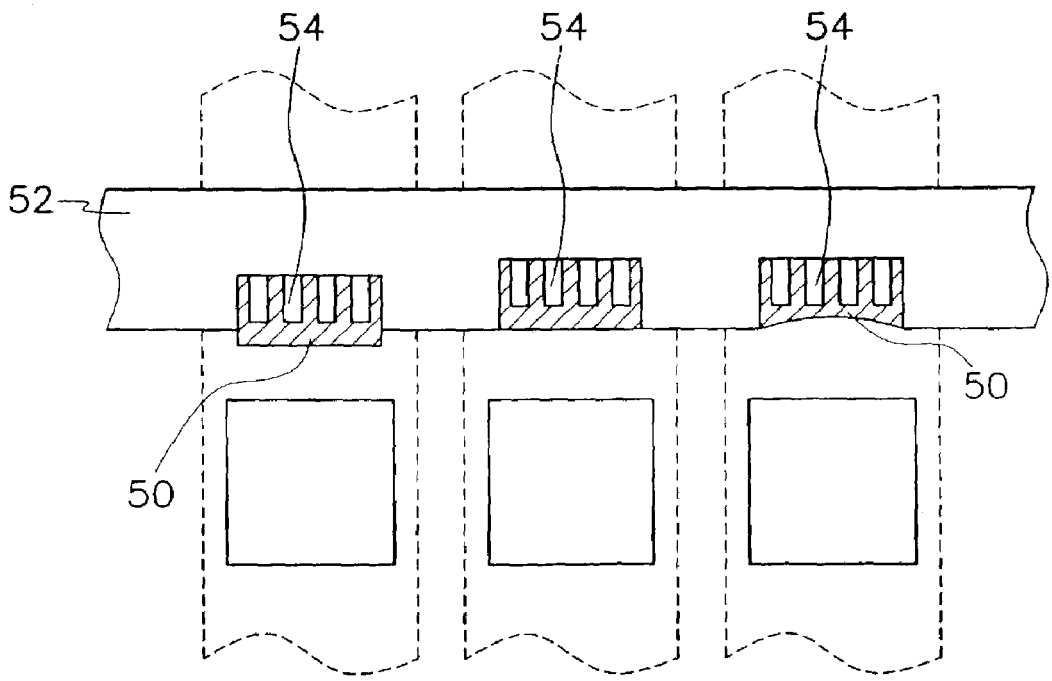
FIG. 11 is a partial plan view used to describe a modified example of the field emission display according to the third embodiment of the present invention.

Further, as shown in FIG. 10, emitters 50 may be formed such that edges thereof closest to an edge of cathode electrodes 52 that form openings of emitter-receiving sections 52*a* do not reach this edge of cathode electrodes 52. Alternatively, the edges of emitters 50 closest to the edge of cathode electrodes 52 that form the openings of emitter-receiving sections 52*a* may extend past this edge of cathode electrodes 52 as shown in FIG. 11. Although not shown, these edges of emitters 50 may be aligned with the corresponding edge of cathode electrodes 52. These outer edges of emitters 50 may also be concavely formed.

With the basic configuration described above, emitters 50 contact a plurality of contact electrodes 54 that are arranged within emitter-receiving sections 52*a* such that the contact area with cathode electrodes 52 is increased. This reduces the contact resistance between emitters 50 and cathode electrodes 52 to enhance electron emission (i.e., to allow for greater emission of electrons from emitters 50). Further, the contact resistance may be varied for each emitter as in the second embodiment of the present invention to enable the uniform emission of electrons.

Figure 12:
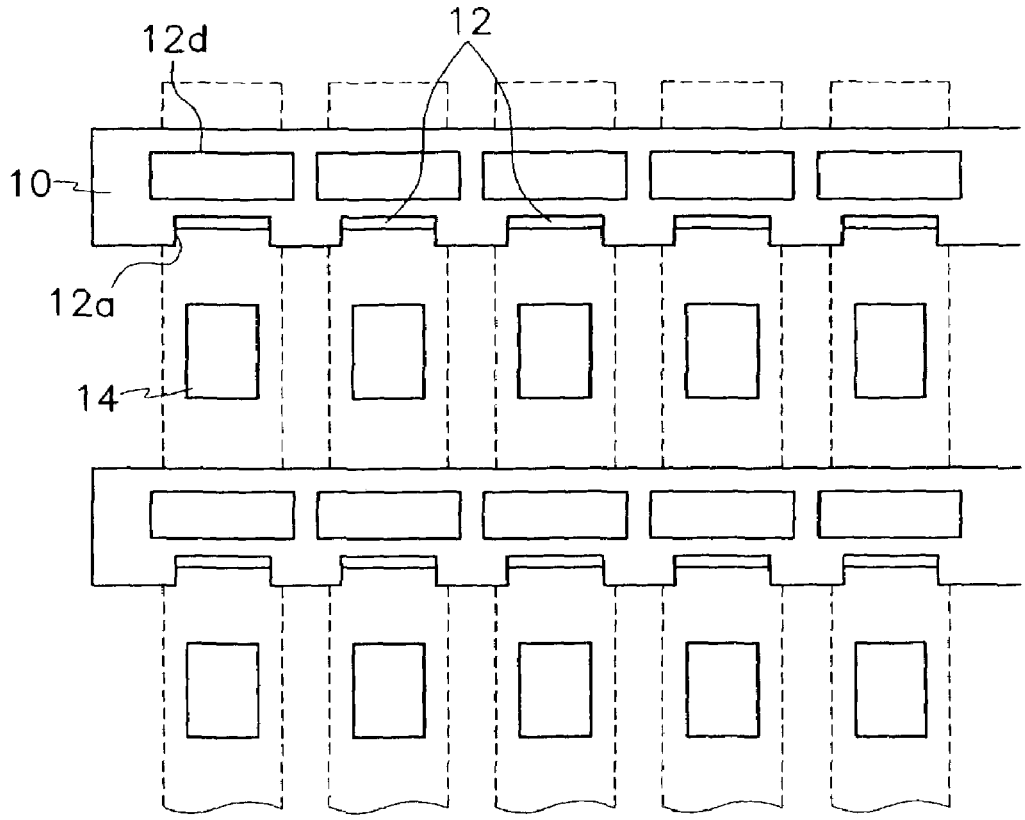
FIG. 12 is a partial plan view used to describe a field emission display according to an additional embodiment of the present invention.

FIG. 12 is a partial plan view used to describe an FED according to an additional embodiment of the present invention. Holes 12*d* of a predetermined size are formed in cathode electrodes 10 adjacent to where each emitter 12 is mounted, that is, adjacent to emitter-receiving sections 12*a*. During operation of the FED, electric fields are formed surrounding each of emitters 12. That is, electric fields are formed from holes 12*d* and from emitter-receiving sections 12*a* such that emitters 12 are surrounded by electric fields. This improves electron emission by emitters 12.

With the refined electron emission characteristics of the FED of the present invention, brightness and overall picture quality are improved, and the emitter lifespan and reliability are enhanced.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A field emission display, comprising:

a first substrate;

a plurality of gate electrodes formed on the first substrate, the gate electrodes being formed along a first direction;

an insulation layer formed on the first substrate covering the gate electrodes;

a plurality of cathode electrodes formed on the insulation layer, the cathode electrodes being formed in substantially parallel stripes extending along a second direction substantially perpendicular to the first direction and having an outer edge along the second direction;

emitters electrically contacting the cathode electrodes;

a second substrate opposing the first substrate with a predetermined gap therebetween, the first substrate and the second substrate forming a vacuum container;

an anode electrode formed on a surface of the second substrate opposing the first substrate; and phosphor layers formed in a predetermined pattern on the anode electrode, wherein portions of the cathode electrodes along the outer edge are removed to form emitter-receiving sections, one of the emitters being provided in each of the emitter-receiving sections electrically contacting the cathode electrodes.

2. A field emission display, comprising:

a first substrate;

a plurality of gate electrodes formed in a predetermined pattern on the first substrate;

an insulation layer formed on the first substrate covering the gate electrodes;

a plurality of cathode electrodes formed in a predetermined pattern on the insulation layer;

emitters electrically contacting the cathode electrodes;

a second substrate opposing the first substrate with a predetermined gap therebetween, the first substrate and the second substrate forming a vacuum container;

an anode electrode formed on a surface of the second substrate opposing the first substrate;

phosphor layers formed in a predetermined pattern on the anode electrode; and a plurality of counter electrodes on the insulation layer at a predetermined distance from the emitters, the counter electrodes being electrically connected to the gate electrodes and acting to form electric fields toward the emitters, wherein portions of the cathode electrodes are removed to form emitter-receiving sections, and fences are formed between the emitter-receiving sections, one of the emitters being provided in each of the emitter-receiving sections electrically contacting the cathode electrodes.

3. The field emission display of claim 2, wherein the emitter-receiving sections are formed at predetermined intervals along lengths of the cathode electrodes.

4. The field emission display of claim 3, wherein the emitter-receiving sections are formed along one edge of the cathode electrodes.

5. The field emission display of claim 2, wherein the emitter-receiving sections are grooves formed along one edge of the cathode electrodes.

6. The field emission display of claim 2, wherein the emitters are provided in the emitter-receiving sections forming a closed space with the cathode electrodes.

7. The field emission display of claim 6, wherein ends of the emitters contact side walls of the cathode electrodes within the emitter-receiving sections.

8. The field emission display of claim 6, wherein each of the emitters are separated into at least two emitters.

9. The field emission display of claim 2, wherein the emitters are mounted within the emitter-receiving sections and extend a predetermined distance onto the cathode electrodes.

10. The field emission display of claim 9, wherein edges of the emitters closest to the fences are mounted fully within the emitter-receiving sections and not reaching corresponding edges of the cathode electrodes.

11. The field emission display of claim 9, wherein edges of the emitters closest to the fences are concavely formed.

12. The field emission display of claim 2, wherein a plurality of contact electrodes are formed at predetermined intervals in each of the emitter-receiving sections, the contact electrodes extending from the cathode electrodes, and the emitters in the emitter-receiving sections contacting the contact electrodes.

13. The field emission display of claim 12, wherein the contact electrodes are quadrilateral.

14. The field emission display of claim 12, wherein edges of the emitters closest to the fences are concavely shaped.

15. The field emission display of claim 12, wherein edges of the emitters closest to the fences are provided fully within the emitter-receiving sections and not reaching a corresponding edge of the cathode electrodes.

16. The field emission display of claim 2, wherein the counter electrodes are connected to the gate electrodes through connecting holes formed in the insulation layer.

17. The field emission display of claim 2, wherein the emitters are made of a carbon-based material.

18. The field emission display of claim 17, wherein the emitters are made of carbon nanotubes, C60 (Fullerene), diamond, DLC (diamond-like carbon), graphite, or a combination of these materials.

19. A field emission display, comprising:

a first substrate;

at least one gate electrode formed on the first substrate, the at least one gate electrode being formed in at least one stripe extending along a first direction;

a plurality of cathode electrodes formed in substantially parallel stripes extending along a second direction substantially perpendicular to the first direction and having an outer edge along the second direction, the cathode electrodes having a thickness along a third direction perpendicular to the substrate;

an insulation layer formed between the at least one gate electrode and the cathode electrodes;

emitters electrically contacting the cathode electrodes;

a second substrate opposing the first substrate with a predetermined gap therebetween, the first substrate and the second substrate forming a vacuum container;

an anode electrode formed on a surface of the second substrate opposing the first substrate; and phosphor layers formed in a predetermined pattern on the anode electrode, wherein portions of the cathode electrodes along the outer edge are removed to form emitter-receiving sections, the emitter-receiving sections extending substantially through the thickness of the cathode electrodes, and portions of the cathode electrodes remaining between the emitter-receiving sections forming fences substantially perpendicular to the second direction and the third direction, one of the emitters being provided in each of the emitter-receiving sections electrically contacting the cathode electrodes.

* * * * *

UNITED STATES PATENT AND TRADEMARK OFFICE

CERTIFICATE OF CORRECTION

PATENT NO. : 7,173,365 B2
APPLICATION NO. : 10/370851
DATED : February 6, 2007
INVENTOR(S) : Chun-Gyoo Lee et al.

It is certified that error appears in the above-identified patent and that said Letters Patent is hereby corrected as shown below:

In the Claims

| | |
|---|---|
| Column 10, line 48, Claim 8 | Delete "are",<br>Insert --is-- |

Signed and Sealed this

Twentieth Day of May, 2008

JON W. DUDAS
*Director of the United States Patent and Trademark Office*